United States Patent [19]

Tsutsui et al.

[11] Patent Number: 4,501,261

[45] Date of Patent: Feb. 26, 1985

[54] INSTANTANEOUS GAS WATER HEATER

[75] Inventors: Osamu Tsutsui; Shusaku Murakami; Hidehiko Kuwahara; Shigefumi Yasunaga, all of Shiga, Japan

[73] Assignee: Toto Limited, Fukuoka, Japan

[21] Appl. No.: 507,917

[22] Filed: Jun. 27, 1983

[30] Foreign Application Priority Data

Jun. 28, 1982 [JP] Japan ..... 57-112127
Mar. 14, 1983 [JP] Japan ..... 58-42617

[51] Int. Cl.[3] ..... F24H 1/00

[52] U.S. Cl. ..... 126/351; 236/20 R; 137/499

[58] Field of Search ..... 126/351, 374; 122/448 R, 446, 447; 236/25 R, 25 A, 20 R; 165/40; 137/499; 237/8 A, 8 R; 431/12

[56] References Cited

U.S. PATENT DOCUMENTS 4,262,843 4/1981 Omori et al. ..... 236/20 R X
4,393,858 7/1983 Mori et al. ..... 126/351

FOREIGN PATENT DOCUMENTS 259815 2/1968 Austria ..... 126/351
3038814 5/1982 Fed. Rep. of Germany ..... 126/351
71754 6/1981 Japan ..... 126/351

*Primary Examiner*—Randall L. Green

*Attorney, Agent, or Firm*—Watson, Cole, Grindle & Watson

[57] ABSTRACT

Hot water supply temperature is set by a temperature setting device in response to an instantaneous flow rate signal from a water flow rate sensor arranged in a water supply pipe and a feeding water temperature signal from a feeding water temperature sensor which are compared with a predetermined hot water supply temperature and calculated in a control unit. A proportional valve and other devices in a gas supply pipe are controlled in response to the result of the comparison and calculation to define a required volume of gas for ignition and heating. At the same time, a fan damper is controlled by a damper control device so as to adjust the volume of combustion air. A signal representing discharging hot water temperature from a discharging hot water temperature sensor arranged in a hot water feeding pipe is fed back to the control unit and calculated therein, and a valve in the hot water supply pipe is adjusted in response to the result of calculation to attain the desired hot water supply temperature. In order to prevent freezing in the system in winter season, a signal from a thermostat in the water feeding pipe is transmitted to a heater arranged in an air supply chamber so as to heat a heat exchanger pipe and, at the same time, heaters arranged in the water feeding pipe and the hot water supply pipe are also controlled to prevent freezing.

15 Claims, 13 Drawing Figures

INSTANTANEOUS GAS WATER HEATER

BACKGROUND OF THE INVENTION

1. Field of the Invention

This invention relates to an instantaneous gas water heater, and more particularly to an instantaneous gas water heater of the type in which a hot water outlet temperature is controlled in response to the volume of burner gas utilized therein.

2. Description of the Prior Art

A conventional instantaneous gas water heater typically contains a proportional valve which controls the volume of gas to be burned therein so as to maintain a constant hot water outlet temperature, a water flow switch therein being turned on or off in response to a differential pressure or to the flow rate of the water. However, this type of conventional instantaneous gas water heater typically exhibits the drawback in that the hot water outlet temperature decreases when the flow rate of water is increased beyond the point where the maximum flow rate of gas burned therein can heat the flowing water to the desired temperature, i.e., due to the physical characteristics of the instantaneous water heater. This disadvantage will be described with reference to FIG. 8.

FIG. 8 shows a characteristic plot of hot water temperature in a conventional instantaneous gas water heater, wherein the abscissa indicates the hot water flow rate Q and the ordinate indicates the hot water outlet temperature T. The dotted line b indicates the water inlet temperature and the solid line a indicates due capacity limitation curve of the water heater. It is common with conventional water heaters that the hot water outlet temperature is set at about 40° C. and that the hot water is fed out directly from a faucet. As shown in FIG. 8, hot water of 40° C. can be obtained when it is flowing at a supply rate less than $Q_1$. When the hot water supply rate exceeds $Q_1$, the hot water outlet temperature decreases along the line a, thereby resulting in a hot water outlet temperature of less than 40° C. Therefore, as described above, even if a gas proportional valve is utilized in order to maintain a constant water temperature for practical convenience, its effect may be insufficient, resulting a lower hot water temperature than is desired.

The conventional type of water heater may experience the following disadvantages when operating under the following conditions:

1. the instantaneous gas water heater with proportional gas operation has a proportional range of 4 Gou to 16 Gou, (where, "Gou" is the Japanese conventional unit meaning output/min. of a water heater, 1 Gou is equal to 25 Kcal/min., therefore 4 Gou is $4\times25-100$ Kcal/min.)

2. the temperature setting of the water heater is 70° C. for high temperature and 35° C. for a low temperature;

3. the temperature of the inlet water is 5° C. to 25° C.;

4. the minimum flow rate of water required for operating a conventional type of water flow switch is approximately 3.0 liter/min., and further when (a) the setting temperature is set at a high temperature of 70° C. and the water inlet temperature is at 5° C., 4 Gou will result in an output of 100 Kcal/min., resulting in the following equations:

$$(1)\quad 100/(70-5) = 1.54 \text{ liter/min.}$$
$$(2)\quad (70-5)\times 3 = 195 \text{ Kcal/min.}$$

The output/min. number, Gou, is calculated according to the equation $Q\times(Ts-Tc)/25=Gou$, where Q is the flow rate, Ts is the setting (desired) temperature and Tc is the inlet water temperature.

$$195/25=7.8 \text{ Gou} \qquad (3)$$

From the equation 1, it is seen that under the above-noted conditions, irrespective of the fact that the water heater has the capability of igniting the burner below a flow rate of 1.54 liter/min., a conventional water heater has a non-usable area shown by the cross hatching in the graph of FIG. 11 since the minimum flow rate of water for operation of the switch is set at 3.0 liter/min. Thus, in practice, burner ignition can be made only in a proportional range of 7.8 Gou as indicated by equations 2 and 3. Therefore, it may occur that a small volume of hot water cannot be obtained or used during the winter season.

(b) when the setting temperature is set at a low temperature of 35° C. and the water feeding temperature is 25° C., the following equations can be attained:

$$(4)\quad 100/(35-25) = 10 \text{ liter/min.}$$
$$(5)\quad (35-25)\times 3 = 30 \text{ Kcal/min.}$$
$$100/3 = 33.3^\circ \text{ C.}$$
$$(6)\quad 25+33.3 = 58.3^\circ \text{ C.}$$

From equation 4, it is seen that a flow rate of 10 liter/min. is required in order to provide hot water at 35° C. In practice, it is apparent from equations 5 and 6 that burner ignition takes place at a flow rate of 3.0 liter/min. Thus at this flow rate the hot water temperature will equal 58.3° C., corresponding to a crossing point between the minimum capacity line of the water heater and the line of 3.0 liter/min. Therefore, when it is desired to use a small volume of tepid water in the summer, only hot water is discharged, potentially resulting in a hot water burn.

Further, a connection from a conventional water heater to a solar system generally cannot be made by a conventional water flow rate switch. Since a flow rate of water of more than 3.0 liter/min. effects burner ignition when inlet water of high temperature flows into the heater, the burner ignition is continued during a minimum level of inlet water even if its temperature is increased. The hot water is thus boiled, causing a safety device and operate to turn off the ignition. That is, when inlet water at 80° C. flows into the water heater, a minimum proportional range is 4 Gou and the volume of hot water is 3 liter/min. The increase in temperature of 100 Kcal/3 liter/min. equals 33.3° C. and results in a hot water outlet temperature of $80^\circ+33.3^\circ=113.3^\circ$ C.

SUMMARY OF THE INVENTION

It is an object of the present invention to overcome the problems described above, to promote an efficient use of a water heater and at the same time to increase the convenience of the water heater. Such objects can be accomplished according to the present invention with a water heater provided with a valve in the feed water supply passage or hot water supply passage for automatically restricting the respective water supply passage so as to limit the flow rate of hot water at a particular setting temperature when the temperature of the hot water, when flowing at a higher rate, cannot be controlled or maintained.

As a result, since the flow rate of water through the water heater is controlled so as to prevent a flow rate of water above a maximum value which can be heated the set temperature, or to a variation in the limitation of the flow rate caused by a variation in the water temperature, once a temperature is set by the temperature setting dial, the set temperature can be maintained all the year round and further the temperature will not decreases.

Display of the temperature in a control box of a conventional instantaneous gas water heater has been vague, showing a range of hot to warm. In contrast, the hot water supply system of the present invention enables the hot water temperature to be set with specificity, and this set temperature will not vary due to either a variation in inlet water temperature or in the flow rate of the hot water, so that the a numerical temperature setting dial may be employed which will always indicate the temperature of the outlet hot water. Therefore, a more convenient water heater can be provided.

It is another object of the present invention provide a water heater which is able to supply a small volume of hot water at a high temperature in the winter season yet will not emit water which is too hot when a small volume of hot water at a relatively low temperature is needed in the summer season, as well as to provide a water heater which can be connected to a solar water heater.

According to the present invention a flow rate of water is sensed by a water flow rate sensor, an inlet water temperature is sensed by a water temperature sensor and a predetermined setting temperature is applied to calculate the required volume of output. When the required output volume calculated is higher than the minimum capacity of the water heater, the burner is ignited, so that a small volume of hot water of high temperature and a certain volume of hot water set at a low setting temperature can be used.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DETAILED DESCRIPTION OF THE PREFERRED EMBODIMENTS

Figure 1:
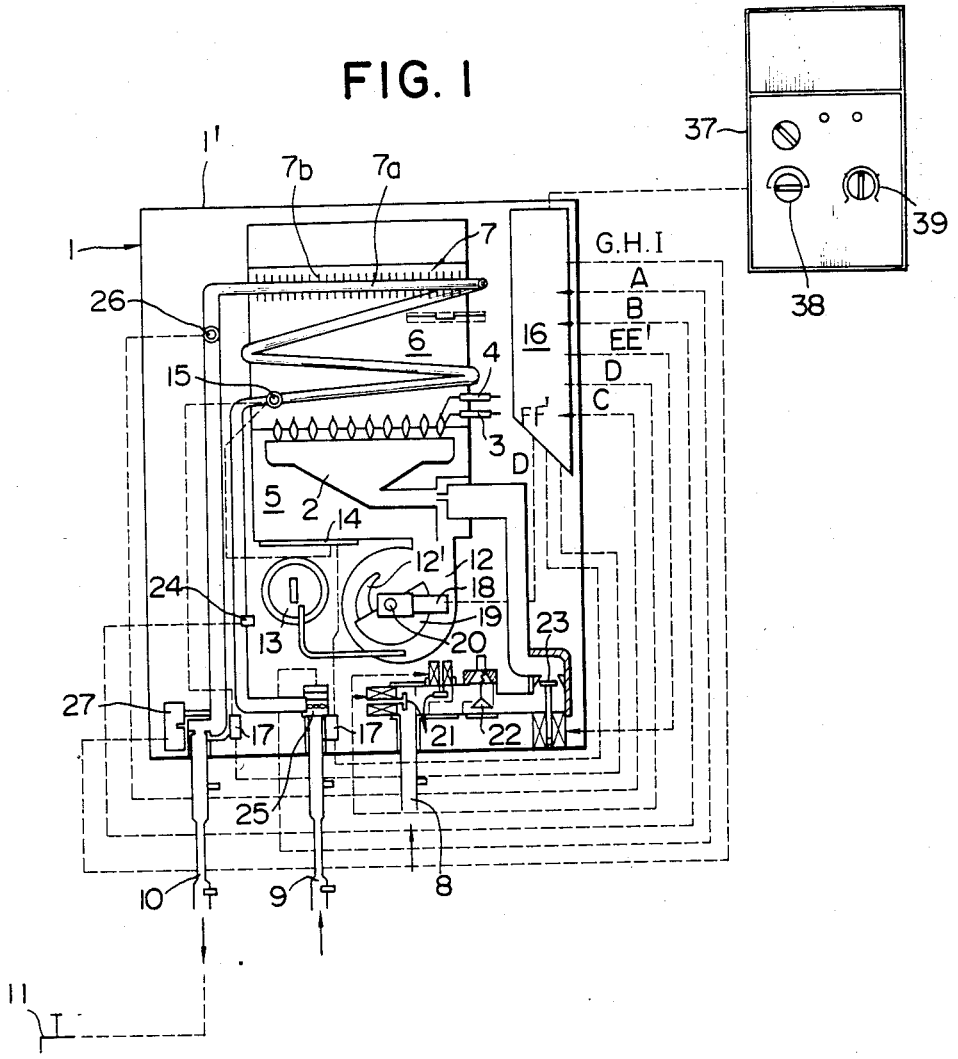
FIG. 1 is a schematic view of an instantaneous gas water heater according to the present invention.

The present invention will be described with reference to the accompanying drawings. In FIG. 1, 1 indicates a hot water supply device, and 1' is a casing of the hot water supply device containing a burner 2 therein. The casing 1' is provided with an air supply chamber 5 having an igniter 3 and a flame rod 4 placed over the burner 2. A combustion chamber 6 is cooperatively arranged over the air supply chamber 5 and a heat exchanger 7 is cooperatively arranged over the combustion chamber 6. Gas is transmitted to the burner 2 through gas supply pipe 8 and ignited and burned with the burner 2. Water to be heated flows into heat exchanger 7*a* through cold water inlet pipe 9 and is heated therein. The heated water then passes through the hot water outlet pipe 10 and on to the faucet 11.

At the lower part of the air supply chamber 5 are arranged a fan 12 for supplying a burner 2 primary air and secondary air required for the combustion of the gas, an air pressure switch 13 for sensing the operation of fan 12, and a heater 14 for preventing freezing of the heat exchanger pipe 7*a* fixed in the heat exchanger 7.

Figure 2:
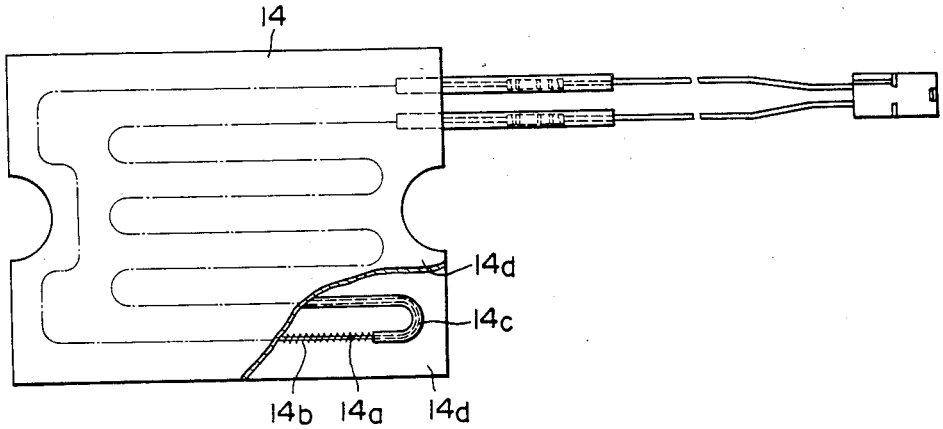
FIG. 2 is a top plan view, partly in section, of a heater which is installed on a bottom surface of the air supply chamber in the instantaneous gas water heater shown in FIG. 1.

As shown in FIG. 2, the heater 14 includes a resistor wire 14*b* helically wound around a heater core 14*a*. The sheath heater has the wound wire 14*b* covered by insulator 14*c* and arranged in a zig-zag form between two aluminum foils 14*d* which are adhered with a double sided adhesive tape. The heater 14 is placed along and pressed against the lower surface of the air supply chamber 5 with an asbestos plate and is fixed thereto. The heater 14 is connected in series with a bimetal thermostat 15 which is placed in, for exmple, the water inlet pipe 9 near the heat exchanger pipe 7*a* and a control unit 16, which will be described below.

Heater 14 is operated in response to the on or off condition of thermostat 15. That is, when the temperature of water in the cold water inlet pipe 9 near the heat exchanger pipe 7*a* is near its freezing point, the thermostat 15 is turned on to energize the heater 14 and warm the air in the air supply chamber 5. The warmed air rises to the heat exchanger 7, such that heat is exchanged with the fins *7b* of the heat exchanger pipe *7a* and the water therein is warmed to prevent its freezing. The thermostat 15 is turned off when the water temperature in the pipe *7a* is increased higher than a specified value and the heater 14 is thereby deenergized. Repetition of the above operation prevents freezing in heat exchanger pipe *7a* and in particular in the heat exchanger 7.

The arrangement of heater 14 at the lower surface of the air supply chamber 5 for heating the air in the heat exchanger 7 protects the heat exchanger pipe *7a* against freezing and provides greater range of protection, a higher efficiency and easier installation of the heater compared to that of a system wherein a tube heater is wound around the water pipe and a positive temperature coefficient ceramic resistor is fixed to the water pipe. Prevention of freezing about the ends of the cold water inlet pipe 9 and the hot water outlet pipe 10 where they project from the casing 1' and are connected to room piping is performed by heaters 17, 17 fixed directly to the cold water inlet pipe 9 and to the hot water outlet pipe 10 at the end portions thereof. Heaters 17, 17 are also connected in series with the thermostat 15 and further connected to the control unit 16 and are operated in response to the on or off condition of the thermostat 15 as described in reference to the heater 14.

Figure 3:
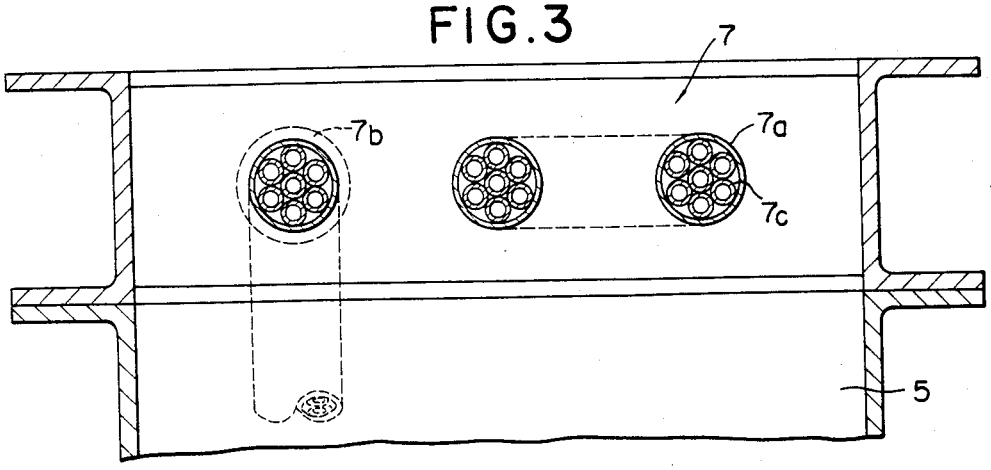
FIG. 3 is a sectional view of a heat exchanger pipe assembly useable in the instantaneous gas water heater shown in FIG. 1.
Figure 4A:
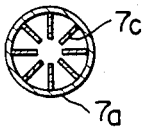
FIGS. 4*a* and 4*b* are sectional views of alternate heat exchanger pipe assemblies which can be used in the instantaneous gas water heater shown in FIG. 1.
Figure 4B:
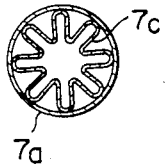

When combustion gas is forcedly drafted with the fan 12, the pitch spacing in the fins *7b* at the outer surface of the heat exchanger pipe *7a* may be reduced. Several metal pipes may communicate with or about the inner wall of the pipe *7a* as shown in FIG. 3 or fin-type heat transmitting elements *7c*, as shown in FIGS. 4*a* and 4*b*, may be arranged in the heat exchanger pipe *7a* so as to form a large inner surface area in the heat exchanger pipe *7a* so as to prevent excessive heating of the heat exchanger pipe *7a* and to prevent noise from being generated.

The fan 12 is provided with a damper 19 which is rotatably driven by a driving device 18 so as to adjust the area of the opening at the air supply side 12' of the fan and thus the volume of air supplied thereto. A position sensor 20 such as a potentiometer is provided for sensing the rotational position of the damper 19. The position sensor 20 and the driving device 18 are electrically connected to the damper control device 16*a* in the control unit 16 described below.

Gas supply pipe 8 is provided with, in upstream sequence, a main solenoid valve 21, governer 22 and a proportional valve 23. The cold water supply pipe 9 is provided with an inlet water temperature sensor 24 and a water flow rate sensor 25. The hot water supply outlet pipe 10 is provided with an outlet hot water temperature sensor 26 and a valve 27. The main solenoid valve 21, proportional valve 23, inlet water temperature sensor 24, water flow rate sensor 25, outlet hot water temperature sensor 26 and valve 27 are each electrically connected to the hot water supply temperature control device 16*b* in the control unit 16.

Figure 5:
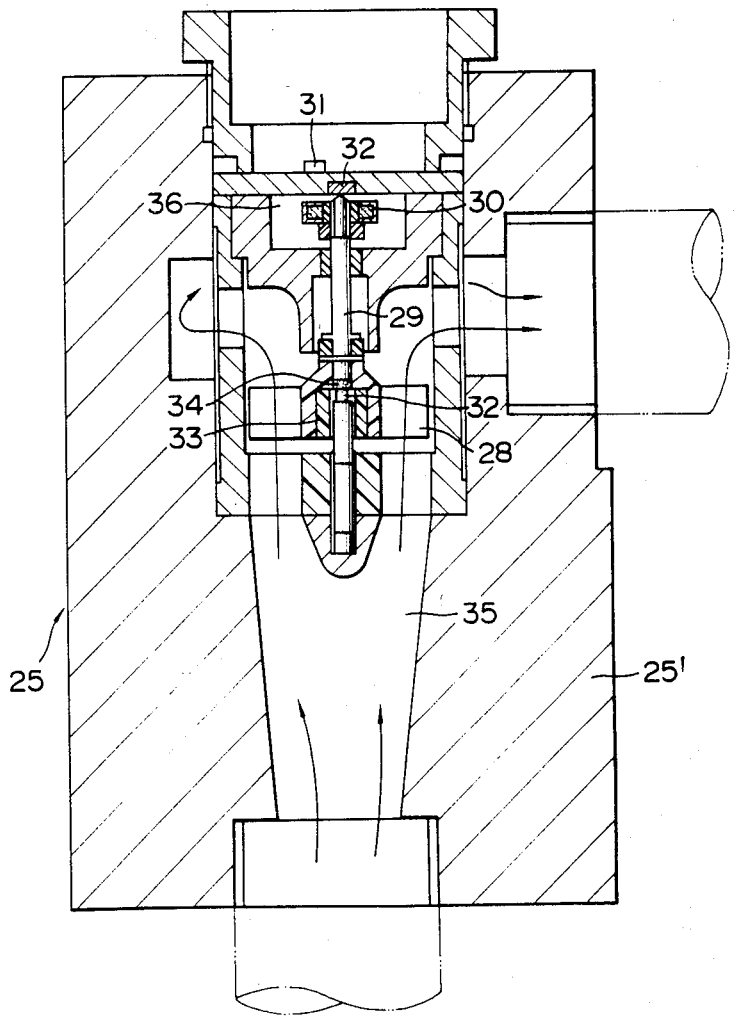
FIG. 5 is a sectional view of the water flow rate sensor in the instantaneous gas water heater shown in FIG. 1.

The water flow rate sensor 25 includes a vane wheel 28 driven by flowing water as shown in FIG. 5 and is rotatably arranged in the middle of the flow passage of the water inlet pipe 9. A magnet 30 is fixed to a rotary shaft 29 of the vane wheel 28 and a sensor element 31 such as, for example, a hole element or reed switch, is provided for sensing a magnetic field. A spacing between the pulses or the number of pulses caused by rotation of the magnet 30 along with the rotation of the vane wheel 28 is detected by the sensor element 31 to detect the instantaneous flow rate of water flowing therethrough. A signal A is transmitted to the hot water temperature control device 16*b* by sensor 25.

The water flow rate sensor 25 will present less rotative resistance if part 32 rotatably supporting the vane wheel 28, parts 33 and 34 slidably contacting the vane wheel 28 and rotary shaft 29 are formed with a material having a superior lubrication characteristic. This will improve the accuracy of sensing the instantaneous flow rate of the water. Vacant chamber 36 is separated from the passage 35 to prevent any new water from entering therein once filled. Chamber 36 is arranged in the main body 25' and magnet 30 is arranged on the rotary shaft 29 of the vane wheel 28 and positioned in the vacant chamber 30. Iron components contained in the flowing water are thereby prevented from adhering to the magnet 30 so as to prevent erroneous sensing.

The inlet cold water temperature sensor 24 and the outlet hot water temperature sensor 26 may each include, for example, a thermistor. The inlet water temperature sensor 24 detects the inlet water temperature and transmits signal B to the hot water supply temperature control device 16*b*. The outlet hot water temperature sensor 26 detects the outlet hot water temperature and transmits signal C to the hot water supply temperature control device 16*b*.

The control unit 16 is arranged in a control box installed at a proper location in the casing 1' and is electrically connected to the remote control box 37 outside of the casing 1'. The remote control box 37 is provided with an on/off change-over switch 38 for use in turning on or off the operation of the hot water supply device and is also provided with a temperature setting device 39.

When the switch 38 in the control box 37 is turned on and the faucet 11 is opened, a flow rate Q is sensed by the water flow rate sensor 25 and transmitted via signal A to the hot water supply temperature control device 16*b*. An inlet water temperature Tc is sensed by the cold water supply inlet temperature sensor 24 and transmitted via signal B, and a setting (desired) temperature Ts is set by the temperature setting device 39. Each of these values is calculated in control unit 16 to determine a output/min number, Gou, according to the equation:

$$Qx(Ts-Tc)/25=\text{Gou}$$

When the calculated value is more than the minimum capacity of the hot water heater, signal D is transmitted to the main solenoid valve 21 and to the fan 12. Upon receipt of signal D, the main solenoid valve 21 opens and the fan 12 starts to operate. That is, both gas and air required for combustion is supplied at such time.

Operation of the fan 12 is detected by the air pressure switch 13. The igniter 3 is operated in response to the sensed air pressure and a spark is produced between the igniter 3 and the burner 2 to ignite the gas injected from flame apertures in the burner 2.

Figure 7:
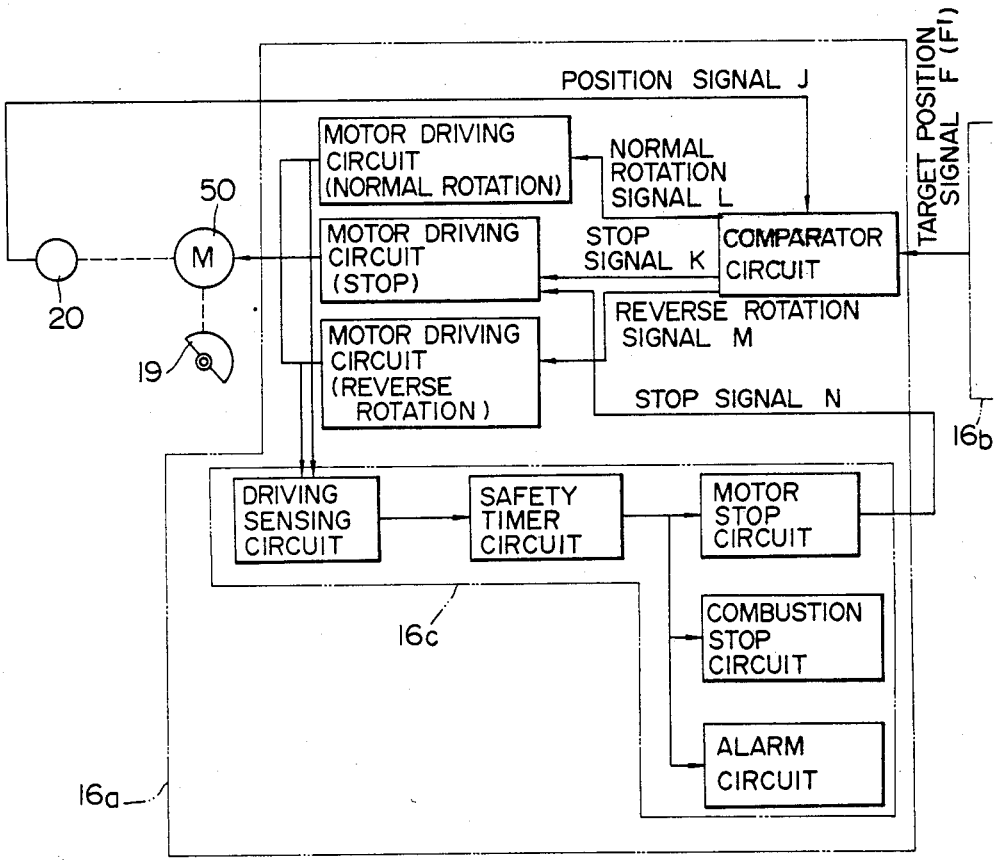
FIG. 7 is a block diagram of the damper control device in the instantaneous gas water heater shown in FIG. 1.
Figure 8:
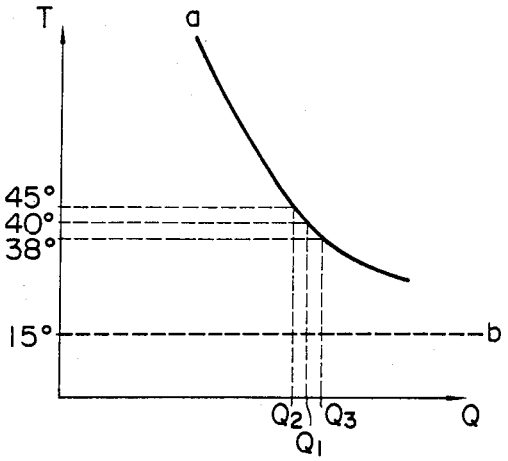
FIG. 8 is a graph showing a characteristic plot of hot water temperature.
Figure 9:
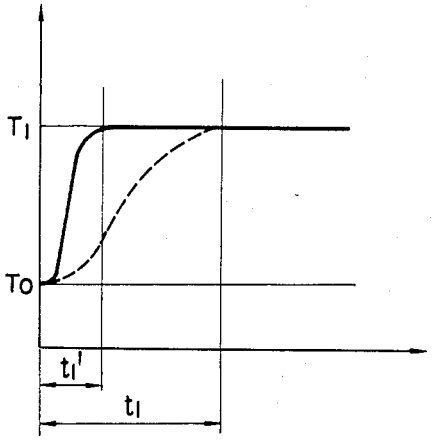
FIG. 9 is a graph of temperature versus time showing a characteristic plot of the temperature rise in the hot water supplied by the hot water supply system of the present invention, indicated by a solid line, and a characteristic plot of the temperature rise in the hot water supplied by a hot water supply system of the prior art, indicated by a dotted line.

As shown in FIGS. 1 and 7, the hot water supply temperature control device 16*b* in the control unit 16 calculates the required volume of gas in response to the inlet water temperature Tc sensed by the inlet water temperature sensor 24, the flow rate Q of water sensed by the water flow rate sensor 25 and the setting temperature Ts set by the temperature setting device 39, and then transmits signal E to the proportional valve 23 and a target position signal F to the damper control device 16*a*. The proportional valve 23 opens to a varied degree in response to the signal E so as to increase or decrease the volume of gas fed to the burner 2, which results in the hot water supply outlet temperature being matched with the setting temperature.

The hot water supply outlet temperature sensed by the outlet hot water sensor 26 is transmitted as signal C to the hot water supply temperature control device 16*b*. The device 16*b* calculates an amount of feedback input in response to the outlet hot water temperature sensed by the discharging hot water temperature sensor 26, the setting temperature Ts and a proportional gain which is defined for every temperature setting step. Device 16*b* transmits the signal E′ to the proportional valve 23, transmits the signal F′ to the damper control device 16*a*, and corrects the degree of opening of the proportional valve 23 and the target position of the damper 19. The effect attained by providing the proportional gain is that the outlet hot water temperature rapidly approaches the setting temperature and that only a slight difference will exist between the setting temperature and the outlet hot water temperature, that is, a small off-set value is produced.

Figure 10A:
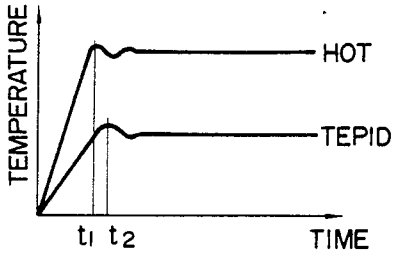
FIGS. 10(*a*) and 10(*b*) are graphs showing temperature rise times characteristic of discharging hot water, wherein FIG. 10(*a*) shows a rise time characteristic of outlet hot water from a conventional type of hot water supply system and FIG. 10(*b*) shows a rise time characteristic of outlet hot water from the hot water supply system of the present invention.
Figure 10B:
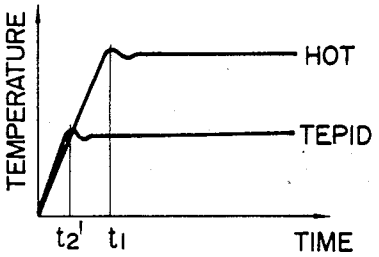
Figure 11:
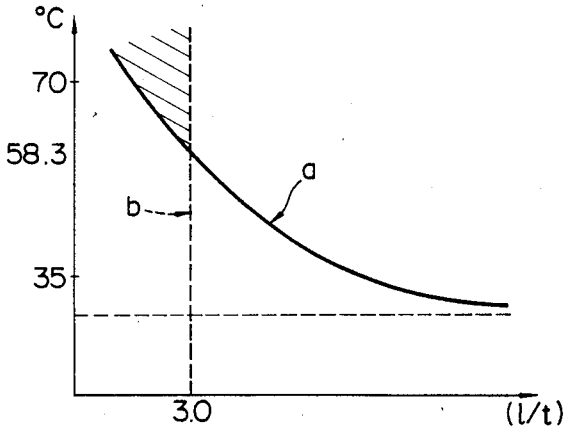
FIG. 11 is a graph representing the operations of the water flow rate switches in the hot water supply device of the present invention and the conventional type of instantaneous gas water heater, wherein the line a is an operative line for the water flow rate switch in the present invention and the line b is an operative line for the water flow rate switch in the conventional system.

Assuming a proportional gain as a constant $\alpha$, the proportional gain $\alpha$ should be defined to generate a condition in which the hot water temperature is not decreased and the hot water temperature should not exhibit any fluctuation under the conditions of an expected minimum inlet water temperature and a maximum setting temperature. However, the proportional gain defined under the above conditions experiences some problems. More particularly, with a low setting temperature, a gradual increase in temperature as shown in FIG. 10(*a*) or a high off-set value in temperature is found to occur. Therefore, in the present invention, the proportional gain is defined for every setting temperature step for a given setting temperature.

For example, the hot water heater may have four setting temperature steps of change-over such as tepid at 35° C., shower at 42° C., slightly hot at 60° C. and hot at 80° C. Where the inlet water temperature ranges from 5° C. to 25° C. and a fine adjusting temperature range of ±5° C. exists for each of the four setting conditions such that "hot" has a maximum setting temperature of 85° and a minimum inlet water temperature of 5° C., "tepid" has a maximum temperature of 40° C. and a minimum inlet water temperature of 5° C., "shower" has a maximum setting of 47° C. and a minimum inlet water temperature of 5° C. and "slightly hot" has a maximum setting temperature of 65° C. and a minimum inlet water temperature of 5° C., proportional gains $\alpha_1$, $\alpha_2$, $\alpha_3$ and $\alpha_4$ corresponding to each of the temperature ranges are calculated and defined by experiment, resulting in the relationship:

$$\alpha_2 > \alpha_3 > \alpha_4 > \alpha_1$$

That is, for $\alpha_2$, an increase in the volume of feed forward gas under its feedback condition is initiated at a higher value compared to that of $\alpha_1$, so that as shown in FIG. 10(*b*) a more rapid increase of gas volume is effected for $\alpha_2$ compared to that of $\alpha_1$. Therefore, a rapid increase in gas volume and decrease of the off-set can be effected in both the "hot" and "tepid" steps of the temperature setting.

Furthermore, the hot water supply temperature control device 16*b* transmits a signal to the valve 27 for decreasing the water flow rate under the three following conditions. In the first condition, signal G is produced when the water flow rate sensor 25 detects an initial flow of water. In the second condition, signal H is provided when a water flow rate limit at the setting temperature is calculated in reference to a inlet water temperature sensed by the inlet water temperature sensor 24 in reference to the setting temperature and in reference to the maximum capacity of the hot water heater 1. At the same time the limitation of water flow rate and the flow rate of water sensed by the water flow rate sensor 25 are compared and calculated, and further when the flow rate of water sensed by the water flow rate sensor 25 exceeds the limitation flow rate of water, or when the outlet hot water temperature sensor 26 detects an outlet hot water temperature lower than the setting temperature continuously over a desired period of time. That is, when a hot water outlet temperature cannot be controlled by the flow rate of gas. In the third condition, signal I is provided when the setting temperature is set at a high value.

Valve 27 thus restricts the flow rate of water supplied for several seconds upon receiving signal G so that the hot water heater 1 heats a small volume of water with the maximum volume of gas for several seconds starting from the initiation of operation of heater 1. In this manner the time required for increasing the hot water temperature up to the predetermined temperature can be reduced below that of a conventional hot water heater having no valve as described above. The valve 27 also restricts the flow rate of water in response to the signal H to prevent a flow of hot water having a flow rate more than a limited flow rate of water at a predetermined temperature.

Figure 6:
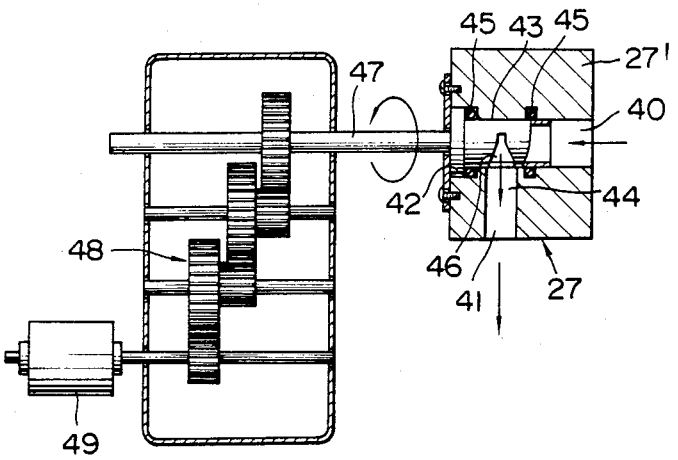
FIG. 6 is a sectional view the water flow valve in the instantaneous gas water heater shown in FIG. 1.

One example of valve 27 is shown in FIG. 6. The valve 27 has an outlet 41 and an inlet 40 formed in the valve body 27′ at a right angle with respect to the outlet 41. A cylindrical valve element 43 is sealingly fitted via seals 45, 45 in passage 44 communicating between the outlet 41 and the inlet 40 from the opening 42 made in the valve body 27′ corresponding to the outlet 41 such that the passage 44 is closed thereby.

Valve element 43 is arranged such that its circumferential surface slidingly contacts the wall surface of the passage 44 and rotates therein. Slit 46 is formed in the circumferential surface of the valve element 43. Water flowing from the outlet 41 passes through the valve element 43 through the slit 46 after entering the inlet 40. The slit 46 is formed such that an area of passage for the water can be varied in response to the rotation of the valve element 43.

The valve element 43 is constructed such that a spindle 47 formed integral therewith is connected to motor 49 through a gear reducer train 48. The rotational speed of motor 49 is decreased by the gear reducer train 48 to rotate the valve element 43. The motor 49 is rotated or stopped in response to the signals G, H and I.

As shown in block diagram form in FIG. 7, the damper control device 16*a* includes a comparator circuit, a motor driving circuit for normal rotation, a motor driving circuit for reversing rotation, a driving sensing circuit, a safety timer circuit, a motor stop circuit, a combustion stop circuit and an alarm circuit.

Normal operation of the damper control device 16*a* will be described in reference to the block diagram of FIG. 7. A target position signal F (F′) sent from the hot water supply temperature control device 16*b* and a present or existing position signal J produced from the position sensor 20 are compared in the comparator circuit in response to a desired position of the fan damper defined by the hot water supply temperature control device 16*b*. Upon coincidence between the signals after the comparison, the comparator circuit produces a stop signal K to the motor driving stop circuit and the geared motor 50 is stopped. When both signals are unequal and the present position signal J is lower than the target position signal F (F'), the comparator circuit produces a normal rotation signal L and transmits such signal to the motor driving circuit for normal rotation. The motor 50 is thus rotated in a normal direction by the motor driving circuit for normal rotation. When the present position signal J is greater than the target position signal F, the comparator circuit produces a reverse rotational signal and transmits signal M to the motor driving circuit for reverse rotation. Geared motor 50 is then rotated in a reverse direction by the motor driving circuit for reverse rotation. Repetition of the above-noted operations produces a desired damper position.

Operation under an abnormal condition is as follows. A normal rotation signal L or a reverse rotation signal M applied to the geared motor 50 is detected by the driving sensing circuit. A duration time of either a normal rotation signal L or a reverse rotation signal M applied to the geared motor 50 is compared with a predetermined safety time by the safety timer circuit. When the former is higher than the latter, a stop signal N is produced from the motor stop circuit and the geared motor 50 is stopped. Combustion is interrupted by the combustion stop circuit and an alarm is produced by the alarm circuit. Therefore, the driving sensing circuit, safety timer circuit, motor stop circuit, combustion stop circuit and alarm circuit form the safety circuit 16*c*.

The reason why the present invention is provided with such a safety circuit as described above is that when the damper is inoperative due to jamming by dust, for example, in a system in which a volume of air supplied is controlled by the damper arranged in the fan in response to a volume of gas fed, even if the gas is being fed at a maximum input volume, the corresponding volume of air may not be fed thereby generating a high yellow flame resulting in a direct contact of the flame with the heat exchanger thereby rendering the same unusable. In addition, even if a minimum volume of gas is fed, a volume of air corresponding to the maximum input volume is fed under such jammed condition so as to cause the flame to be lifted up, and unburned gas to be discharged. Moreover, the flame may be blown off so as to cause a fire. This condition is quite dangerous. The above-mentioned problems may be overcome by the safety device described above.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An instantaneous gas water heater for providing a flow of water at a preset temperature, said water heater comprising an air supply chamber, a burner within said air supply chamber for burning combustion gas supplied thereto, a gas supply pipe for supplying combustion gas to said burner, a proportional valve located within said gas supply pipe, a combustion chamber located above said air supply chamber, a fan associated with said air supply chamber for supplying primary and secondary air thereto for combustion, a heat exchanger positioned in said combustion chamber, said heat exchanger having an input end and an outlet end, a water input pipe connected to said input end of said heat exchanger for supplying cold water thereto, a water outlet pipe connected to said outlet end of said heat exchanger for delivering hot water therefrom, a control unit, a water flow rate sensor located in said water inlet pipe which is electrically connected to said control unit for sending a water flow rate signal A thereto, a water temperature sensor located in said water inlet pipe which is electrically connected to said control unit for sending a cold inlet water signal B thereto, a water temperature sensor located in said water outlet pipe which is electrically connected to said control unit for sending a hot outlet water signal C thereto, a temperature setting means which is electrically connected to said control unit for sending a temperature setting value signal $T_s$ thereto, a flow control valve within one of said water input and water outlet pipes to control the flow rate of water therethrough, and said control unit being electrically connected to said proportional valve and to said flow control valve so as to control their operation, said control unit sending both a primary signal E and a secondary signal E' to said proportional valve, said primary signal E representing the value obtained by multiplying the signal A by the value achieved by subtracting signal B from signal $T_2$ and then dividing the result by the predetermined heat efficiency of the heat exchanger, and the secondary signal E' representing the value obtained by multiplying a predetermined proportional gain value $\alpha$ wherein $\alpha$ is one of a plurality of predetermined values with different temperatures associated with Ts with the value obtained by subtracting signal C from signal $T_s$; said control unit controlling the opening of said flow control valve so as to assure that the temperature of the water flowing through the water outlet pipe is essentially equal to $T_s$.

2. An instantaneous gas water heater as set forth in claim 1 wherein the control device causes said flow control valve to throttle when the signal A is greater than a predetermined maximum.

3. An instantaneous gas water heater as set forth in claim 1 wherein the control device causes said flow valve to throttle when signal C is less than signal $T_s$ continuously over a specified period of time.

4. An instantaneous gas water heater as set forth in claim 1 wherein said water outlet pipe is connected to a faucet, and wherein said control device causes said flow control valve to throttle when said faucet is initially opened.

5. An instantaneous gas water heater as set forth in claim 1 wherein said water control valve comprises a cylindrical body having an inlet and an outlet and a valve element movable therewithin, said valve element having a circumferential surface portion with a slit therein which slidingly and rotatingly contacts a wall surface portion of the valve body, such that water flows from the inlet, through the slit formed in the valve element to the outlet, and such that the slit causes a passing area of water to be varied in response to rotation of the valve element within the valve body.

6. An instantaneous gas water heater as set forth in claim 1 including a damper for use in controlling the volume of air supplied to said fan in response to the input volume of combustion gas.

7. An instantaneous gas water heater as set forth in claim 1 wherein said fan comprises an air supply side portion and an air intake side portion, and wherein said water heater includes a damper rotatably located at said air supply side to define a variable opening area, a driving device for operating the damper and a driving device for controlling the operation of the damper, and, further comprising a safety circuit for terminating the operation of the water heater when a signal for rotating the damper for a desired angle in a specified direction in response to the input volume of combustion gas is transmitted continuously even after a predetermined time required for rotating the damper to the angle has expired.

8. An instantaneous gas water heater as set forth in claim 1 further comprising a heater arranged at a lower surface portion of the air supply chamber.

9. An instantaneous gas water heater as set forth in claim 1 wherein the water flow rate sensor comprises a main body having an inlet and an outlet formed therein and mutually communicating with each other via a plurality of passages, a vane wheel driven by water flowing through the passages and rotated thereby, a magnet integrally arranged on a rotary shaft of the vane wheel, and a sensor element for sensing a magnetic field of the magnet and sensing a flow rate of water under a rotation of the magnet along with the rotation of the vane wheel wherein the main body is provided with a vacant chamber formed therein and spaced from the passages such that the rotary shaft of the vane wheel is inserted into the vacant chamber to locate the magnet within the vacant chamber.

10. An instantaneous gas water heater as set forth in claim 9 wherein the water flow rate sensor further comprises a material having a superior lubricity for rotatably supporting the vane wheel and for slidingly contacting the vane wheel and the rotary shaft.

11. An instantaneous gas water heater as set forth in claim 1 wherein the heat exchanger comprises a heat exchanger pipe provided with a thermo-conductor means communicating with a wall portion of the heat exchanger pipe.

12. An instantaneous gas water heater as set forth in claim 11 wherein the thermo-conductor means comprises a metal pipe.

13. An instantaneous gas water heater as set forth in claim 11 wherein the thermo-conductor means is mounted in the heat exchanger pipe and comprises fins projecting from an inner circumferential surface portion of the heat exchanger pipe.

14. An instantaneous gas water heater as set forth in claim 1 wherein said temperature setting means is capable of emitting a plurality of stepped temperature setting values $T_s$ to said control unit and wherein the proportional gain is defined for each of the setting steps of the predetermined temperature.

15. An instantaneous gas water heater for providing a flow of water at a preset temperature, said water heater comprising an air supply chamber, a burner within said air supply chamber for burning combustion gas supplied thereto, a gas supply pipe for supplying combustion gas to said burner, a proportional valve located within said gas supply pipe, a combustion chamber located above said air supply chamber, a fan associated with said air supply chamber for supplying primary and secondary air thereto for combustion, a heat exchanger positioned in said combustion chamber, said heat exchanger having an input end and an outlet end, a water input pipe connected to said input end of said heat exchanger for supplying cold water thereto, a water outlet pipe connected to said outlet end of said heat exchanger for delivering hot water therefrom, a control unit, a water flow rate sensor located in said water inlet pipe which is electrically connected to said control unit for sending a water flow rate signal A thereto, a water temperature sensor located in said water inlet pipe which is electrically connected to said control unit for sending a cold inlet water signal B thereto, a water temperature sensor located in said water outlet pipe which is electrically connected to said control unit for sending a hot outlet water signal C thereto, a temperature setting means which is electrically connected to said control unit for sending a temperature setting value signal $T_s$ thereto, a flow control valve within one of said water input and water outlet pipes to control the flow rate of water therethrough, and said control unit being electrically connected to said proportional valve and to said flow control valve so as to control their operation, said control unit sending both a primary signal E and a secondary signal E′ to said proportional valve, said primary signal E representing the value obtained by multiplying the signal A by the value achieved by subtracting signal B from signal $T_s$ and then dividing the result by the predetermined heat efficiency of the heat exchanger, and the secondary signal E′ representing the value obtained by multiplying a predetermined gain value $\alpha$ wherein $\alpha$ is one of a plurality of predetermined values with different temperatures associated with Ts with the value obtained by subtracting signal C from signal $T_s$; said control unit calculates a required output value based on signals A, B and $T_s$; wherein said burner is caused to ignite when the required output value is more than the minimum capacity of the water heater and wherein said control unit controls the opening of said flow control valve so as to assure that the temperature of the water flowing through the water outlet pipe is essentially equal to $T_s$.

* * * * *